US006788260B2

(12) United States Patent
Sullivan et al.

(10) Patent No.: US 6,788,260 B2
(45) Date of Patent: Sep. 7, 2004

(54) ANTENNA WITH CAP

(75) Inventors: Jonathan L. Sullivan, Lincoln, NE (US); Anthony P. Vejraska, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 15 days.

(21) Appl. No.: 10/322,948

(22) Filed: Dec. 18, 2002

(65) Prior Publication Data

US 2004/0119649 A1 Jun. 24, 2004

(51) Int. Cl.[7] ..... H01Q 1/24
(52) U.S. Cl. ..... 343/702; 343/715; 343/872
(58) Field of Search ..... 343/702, 715, 343/900, 901, 872

(56) References Cited

U.S. PATENT DOCUMENTS

| | | | | | |
|---|---|---|---|---|---|
| 6,107,966 | A | * | 8/2000 | Fahlberg | 343/702 |
| 6,212,400 | B1 | * | 4/2001 | Scholz | 455/575.7 |
| 6,236,369 | B1 | * | 5/2001 | Krishtul et al. | 343/702 |
| 6,288,681 | B1 | * | 9/2001 | Kim et al. | 343/702 |
| 6,310,578 | B1 | * | 10/2001 | Ying | 343/702 |
| 6,317,086 | B1 | * | 11/2001 | Woo | 343/702 |
| 6,573,870 | B1 | * | 6/2003 | Chang | 343/702 |
| 2001/0023178 | A1 | * | 9/2001 | Amano et al. | 455/83 |
| 2002/0135533 | A1 | * | 9/2002 | Kim et al. | 343/901 |

* cited by examiner

*Primary Examiner*—Tan Ho
(74) *Attorney, Agent, or Firm*—Holland & Hart

(57) ABSTRACT

The present invention provides antenna assemblies for wireless devices where the antenna has a tip with at least one barb and a cap with at least one internal groove. The barb and groove mate to form a snap lock. The snap lock resists pressure tending to pull the cap off the antenna.

15 Claims, 3 Drawing Sheets

ANTENNA WITH CAP

FIELD OF THE INVENTION

The present invention relates to antennas and, more particularly, to antennas having a snap on or friction fit cap at one end.

BACKGROUND OF THE INVENTION

Both portable and non-portable wireless devices use many types of antennas and antenna systems. Many of the common antennas used today are mounted on the outside of the wireless device, such as on the chassis or housing. These antennas are classified generically as external antennas. Some common examples of these antenna are helical wound radiator antennas (a.k.a. stubby antennas), elongated radiator antennas (a.k.a. whip antennas), retractable whip antennas, and telescopic whip antennas to name a few. Another generic category of antenna is the internal antenna, which is generally less prone to damage because it is encased in the housing, but often not as efficient as an external antenna. Retractable and telescopic antennas combine the protection of internal antennas during periods of nonuse, and the efficiency of external antenna during use.

Because of the increase in wireless technologies and communications, there has been an increased push for improvement of old designs and a development of new and innovative solutions in the design and function of antennas. Generally, the pushes fall largely into one of several categories, such as, better performance, reduced size, reduced weight, style, etc.

One such area for improvement is the telescopic or retractable antenna. In particular, caps on the end of whip antennas is vulnerable and subject to damage due to normal operation. Normal operation requires a user to repeatedly extend and retract the antenna by pulling and pushing on the cap. Further, the cap is susceptible to damage from dropping the wireless device on the cap or catching the cap an object or edge. In addition, the whip antenna and subsequently the cap can be abused by uses, such abuses include, for example, chewing by nervous users, stirring hot drinks, and the like. Failure of the cap may seem trivial, but in some situations it could cause a catastrophic failure of the handset. For instance, the antenna may fall inside the wireless device, which could cause electrical shorting. Also, a wire antenna without a cap would be relatively sharp and could possibly poke the user.

SUMMARY OF THE INVENTION

To attain the advantages of and in accordance with the purpose of the present invention, antenna assemblies with a cap are provided. The antenna assembly includes a flexible wire section having a proximate end and a distal end. The proximate end is coupled to a wireless device and a tip resides towards the distal end. The tip has at least one barb formed thereon. A cap has at least one mating surface and is installed on the tip such that the at least one mating surface engages the at least one barb.

The foregoing and other features, utilities and advantages of the invention will be apparent from the following more particular description of a preferred embodiment of the invention as illustrated in the accompanying drawings.

BRIEF DESCRIPTION OF THE DRAWING

The above and other objects and advantages of the present invention will be apparent upon consideration of the following detailed description, taken in conjunction with the accompanying drawings, in which like reference characters refer to like parts throughout, and in which.

DETAILED DESCRIPTION

Figure 1:
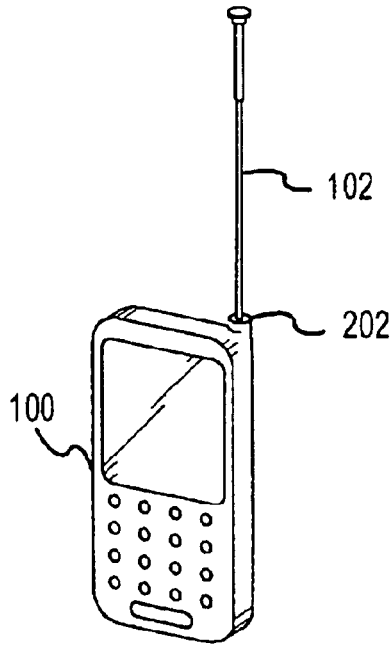
FIG. 1 is a perspective view of a wireless device having an antenna consistent with the present invention.
Figure 2:
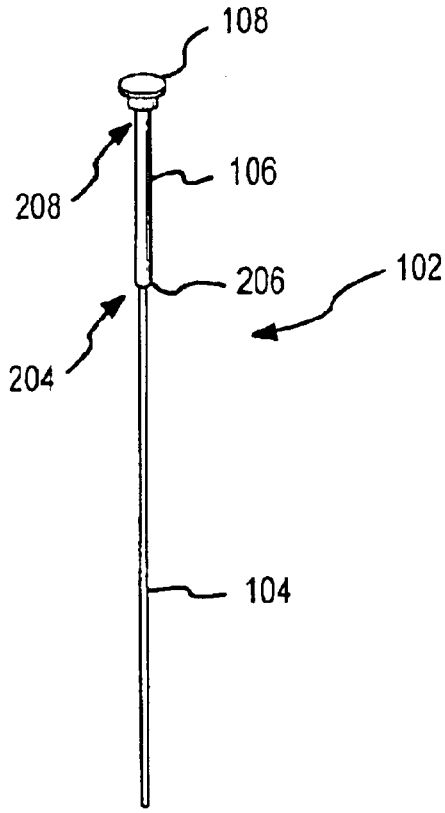
FIG. 2 is a perspective view of the telescopic whip type antenna of FIG. 1.

The present invention will now be described with reference to FIGS. 1 to 5. With reference to FIG. 1, a cellular telephone 100 is shown with a retractable, telescopic whip antenna 102 mounted on cellular telephone 100. FIG. 2 illustrates antenna 102 in more detail. As can be seen, antenna 102 has a flexible wire section 104, and a telescopic tube portion 106, which together make up the radiating portion of the antenna. A cap 108 is installed on the end of the telescopic tub. Flexible wire portion 104 has a proximate end 202 connected to cellular telephone 100 and a distal end 204. Distal end 204 is connected to a receptacle 206 of telescopic tube portion 106. Telescopic tube portion 106 also has a tip 208 opposite receptacle 206. Tip 208 is adapted to receive cap 108. While the present invention will be described in conjunction with a retractable, telescopic whip antenna, it should be understood that alternative style antennas could be equipped with only a cap and not a telescopic tube. Further, while shown that distal end 204 extends into a hollow of receptacle 206, alternative configurations are possible. For example, distal end 204 could have a hollow portion in which receptacle 206 fits or the like. Further, telescopic tube portion 106 could be eliminated from the design, in which case cap 108 would be connected directly to distal end 204.

Figure 5:
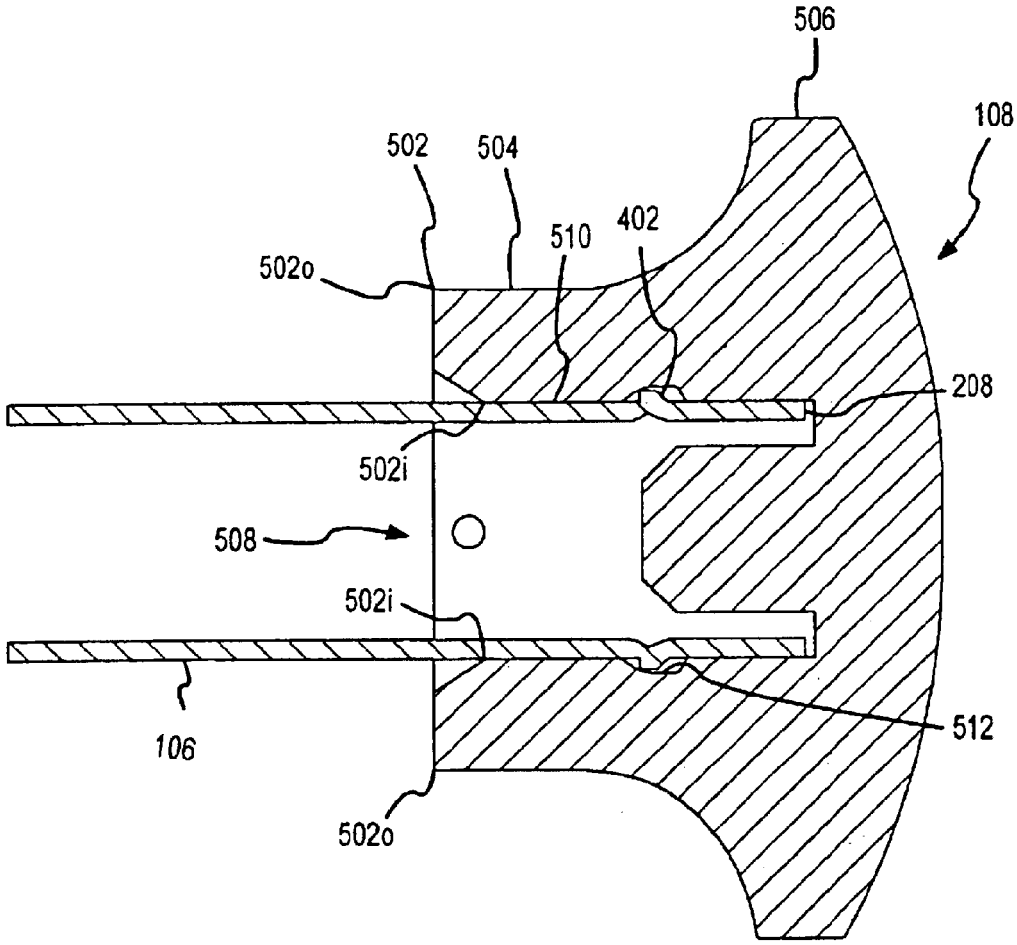
FIG. 5 is a cross sectional view of a cap and telescopic tube illustrative of one embodiment of the present invention.

Referring now to FIG. 5, cap 108 installed on telescopic tube portion 106 is shown in more detail. Cap 108 can be manufactured numerous ways, but it is believed a simple injection molded part would be sufficient. Cap 108 has a base 502, base sidewalls 504, and a flanged top 506. Base 502 has an outer edge **502*o* and an inner edge 502*i*. Inner edge 502*i* defines a base opening 508 having a first diameter sufficient to fit snuggly over tip 208 of telescopic tube portion 106. Extending internal from inner edge 502*i* are base opening inside walls 510 that contain an inside groove 512. Inside groove forms an undercut geometry, which can be used for a snap lock feature (explained further below). Inside groove 512 extends from base opening inside walls 510 towards base sidewalls 504. The remainder of cap 108** can be hollow or solid as a matter of design choice.

Figure 3:
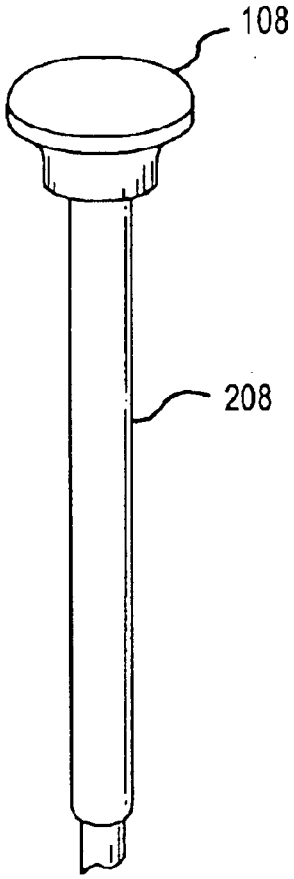
FIG. 3 is a perspective view of the telescopic section of the whip type antenna of FIG. 2.
Figure 4:
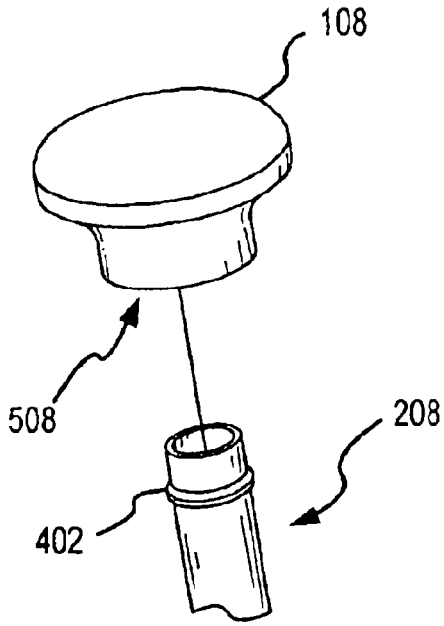
FIG. 4 is a perspective, exploded view of the telescopic section and cap of the antenna of FIG. 2.

Referring now to FIG. 4, tip 208 is shown with a barb 402. Cap 108 is installed on tip 208 by forcing tip 208 into base opening 508. The barb 402 interferers with the inside wall 510 until barb 402 snaps in inside groove 512. Ideally, the inside diameter of inside groove 512 is the same diameter or bigger than a diameter of barb 402 so not to displace plastic material of cap 108 during normal operation. Thus, when fully installed, as shown in FIG. 3, barb 402 is captured within the inside groove 512 will resist pressure tending to pull cap 108 off tip 208. While FIG. 5 shows a rib (or barb) and groove style connection, other connections are of course possible. Some non limiting examples include a pin and detent, a spring loaded arm and notch, a flange and shoulder matting surface, or the like. Also, while shown as singular connections, multiple grooves and barbs could be used.

Alternative to the above (and not shown in the figures), tip 208 could be hollow such that external barb 402 could be replaced by an internal shoulder extending internal to hollow tip 208. In this case, base 502 would have a flanged portion forming a mating shelf such that when installed, base 502 would slide in tip 208 until the mating shelf snapped in place below the internal shoulder. Thus, when fully installed the flanged mating shelf resting on the internal shoulder would resist pressure tending to pull cap 108 off tip 208.

Generally, the cap is designed to fit snuggly over or in tip 208 such that the interface between the flanged surfaces and the snugness combine to resist outward press. The system could be designed to ease installation by, for example making the opening diameter be slightly larger than the tip diameter. Alternatively, the barb feature could be removed and a friction fitting could be designed to hold the cap in place.

While the invention has been particularly shown and described with reference to an embodiment thereof, it will be understood by those skilled in the art that various other changes in the form and details may be made without departing from the spirit and scope of the invention.

We claim:

1. An antenna assembly, comprising:

a flexible wire section having a proximate end and a distal end;

a tip, the tip having at least one barb;

the tip being located towards the distal end of the flexible wire section;

a cap;

the cap having at least one mating surface; and the cap is coupled to the tip such that the at least one mating surface engages the at least one barb.

2. The antenna assembly according to claim 1, wherein:

the at least one barb is external to the tip; and the at least one mating surface is a groove internal to cap.

3. The antenna assembly according to claim 1, wherein:

the tip has a hollow portion;

the at least one barb is internal to the tip; and the at least one mating surface is a flanged surface at a base of the cap.

4. The antenna assembly according to claim 1, wherein:

the cap is injection molded plastic.

5. The antenna assembly according to claim 1, further comprising:

a telescopic portion coupled to the distal end; and the cap coupled to the telescopic portion, such that the telescopic portion resides between the flexible wire section and the cap.

6. The antenna assembly according to claim 1, further comprising:

a mount to attach the flexible wire section to a wireless device.

7. The antenna assembly according to claim 6, wherein the wireless device comprises at least one of the group consisting of a cellular telephone, a desktop computer, a laptop computer, a personal digital assistant, an electronic game, a digital video disk player, a television, a compact disk player, and a radio.

8. An antenna assembly, comprising:

a flexible wire section having a proximate end and a distal end;

a tip;

the tip being located towards the distal end of the flexible wire section;

a cap; and means for attaching the cap to the tip to resist pressure tending to remove the cap from the tip, wherein the means for attaching the cap to the tip comprises at least one barb on the tip and at least one groove internal to the cap, such that the at least one barb and the at least one groove form a snap lock.

9. An antenna assembly, comprising:

a flexible wire section having a proximate end and a distal end;

a tip;

the tip being located towards the distal end of the flexible wire section;

a cap; and means for attaching the cap to the tip to resist pressure tending to remove the cap from the tip, wherein the means for attaching the cap to the tip comprises at least one barb in the tip and at least one flanged surface on the base of the cap, such that the at least one barb and the at least one flanged surface form a snap lock.

10. An antenna assembly, comprising:

a flexible wire section having a proximate end and a distal end;

a tip;

the tip being located towards the distal end of the flexible wire section;

a cap; and means for attaching the cap to the tip to resist pressure tending to remove the cap from the tip, wherein the means for attaching the cap to the tip comprises a friction fitting.

11. A wireless device, comprising:

a wireless device having a housing; and an antenna assembly attached to the housing, the antenna assembly comprising:

a flexible wire section having a proximate end and a distal end;

a tip, the tip having a barb;

the tip being located towards the distal end of the flexible wire section;

a cap;

the cap having a mating surface; and the cap is coupled to the tip such that the mating surface engages the barb.

12. The wireless device according to claim 11, wherein the antenna assembly is a retracting antenna assembly.

13. The wireless device according to claim 11, wherein the antenna assembly is a telescopic antenna assembly.

14. The wireless device according to claim 11, wherein the antenna assembly is a retractable, telescopic antenna assembly.

15. The wireless device according to claim 11, wherein the wireless device comprises at least one of the group consisting of a cellular telephone, a desktop computer, a laptop computer, a personal digital assistant, an electronic game, a digital video disk player, a television, a compact disk player, and a radio.

* * * * *